US008038019B2

(12) United States Patent
Wagner

(10) Patent No.: US 8,038,019 B2
(45) Date of Patent: Oct. 18, 2011

(54) JUMP ROPE CART ASSEMBLY

(75) Inventor: Michael Wagner, Stillwater, MN (US)

(73) Assignee: The Prophet Corporation, Owatonna, MN (US)

( * ) Notice: Subject to any disclaimer, the term of this patent is extended or adjusted under 35 U.S.C. 154(b) by 254 days.

(21) Appl. No.: 12/268,131

(22) Filed: Nov. 10, 2008

(65) Prior Publication Data

US 2010/0116761 A1 May 13, 2010

(51) Int. Cl.
*A47F 1/04* (2006.01)
*A47F 7/00* (2006.01)

(52) U.S. Cl. ..... 211/60.1; 211/10; 211/85.7

(58) Field of Classification Search ..... 211/10, 211/12, 85.3, 85.5, 85.7, 85.8, 60.1, 61, 62, 211/64, 67, 206, 204, 189, 70.5, 182; 248/80, 248/83, 89, 90, 121, 122.1, 129, 146; 482/82
See application file for complete search history.

(56) References Cited

U.S. PATENT DOCUMENTS

| | | | | |
|---|---|---|---|---|
| D34,010 | S * | 1/1901 | Martin | D6/464 |
| 1,306,297 | A | 6/1919 | Auerochs | |
| 1,543,501 | A * | 6/1925 | Hiatt | 211/65 |
| 2,020,193 | A | 6/1933 | Klin | |
| 2,114,424 | A * | 4/1938 | Jesse et al. | 211/85.3 |
| D111,210 | S | 7/1938 | McCurrach | |
| 2,239,360 | A * | 4/1941 | Bersin | 211/182 |
| D182,483 | S | 4/1958 | Skinner | |
| 2,968,407 | A | 6/1958 | Dresser | |
| 2,920,765 | A * | 1/1960 | Royer | 211/10 |
| 3,409,141 | A | 11/1968 | Cunningham, Jr. et al. | |
| D230,969 | S | 3/1974 | Saltzman | |
| 4,315,633 | A | 2/1982 | Boeddeker et al. | |
| 5,487,473 | A * | 1/1996 | Ford | 211/59.1 |
| 5,526,941 | A * | 6/1996 | Ford | 211/59.1 |
| 5,533,947 | A * | 7/1996 | Tomlinson et al. | 482/6 |

(Continued)

FOREIGN PATENT DOCUMENTS

DE 296119621 11/1996

OTHER PUBLICATIONS

DuraCart Jump Rope Tree, 2007, www.duracart.com/OurProducts_Racks_2_JumpRopeTree.aspx.
DuraCart Al Terrain Jump Rope Cart, 2007, www/duracart.com/OurProducts_AllTerrain_2_JumpRopeCart.aspx.
DuraCart EZ Jump Rope Cart, 2007, www.duracart.com/OurProducts_Racks_3_EZReachJumpRope.aspx.

(Continued)

*Primary Examiner* — Darnell Jayne
*Assistant Examiner* — Stanton L Krycinski
(74) *Attorney, Agent, or Firm* — Merchant & Gould P.C.

(57) ABSTRACT

A jump rope cart assembly includes a frame having a base portion, a hanger portion and a plurality of indicium. The hanger portion, which includes a plurality of holders, is supported by the base portion. The plurality of indicium is disposed on the frame. Each of the plurality of is adapted to correspond to a length of jump rope. The jump rope cart assembly further includes a plurality of jump rope of different lengths disposed on the holders. A method for using a cart assembly includes providing a cart assembly having a plurality of jump rope. The cart assembly includes a plurality of indicium corresponding to lengths of jump rope. A height of a reference location on a user is compared to the indicium disposed on the cart assembly. A jump rope is selected which corresponds to the indicium that is closest to the height of the reference location.

9 Claims, 8 Drawing Sheets

U.S. PATENT DOCUMENTS

| | | | | |
|---|---|---|---|---|
| 5,582,292 | A | 12/1996 | Cabe | |
| 6,182,920 | B1 * | 2/2001 | Watkins | 242/594.4 |
| 6,224,072 | B1 * | 5/2001 | Weck et al. | 280/47.35 |
| 6,264,046 | B1 | 7/2001 | Ford | |
| 6,422,504 | B1 | 7/2002 | Elder | |
| D494,777 | S * | 8/2004 | Walk | D6/465 |
| D526,105 | S | 8/2006 | Van Es | |

OTHER PUBLICATIONS

Rolling Jump Rope Rack, 2007, www.flaghouse.com/itemdy00.asp?TI=7494.

Standing Jump Rope Racks, 2007, www.shapeushop.com/games/jumpropes/standing_racks.htm.

* cited by examiner

JUMP ROPE CART ASSEMBLY

BACKGROUND

Jumping rope is an activity that is performed by people of various ages and fitness levels since it builds coordination and provides an aerobic workout. Jumping rope can strengthen legs, arms and shoulders. In jumping rope, the impact of each jump is absorbed by both legs. Therefore, jumping rope is considered by some to be low impact activity. As a low impact activity, the risk of knee injury to the person resulting from the impact of the jump is reduced. While the risk of knee injury may be reduced, other injuries may result from the person selecting a jump rope that is either too long or too short.

SUMMARY

An aspect of the present disclosure relates to a jump rope cart assembly having a frame including a base portion, a hanger portion and a plurality of indicium. The hanger portion is supported by the base portion. The hanger portion includes a plurality of holders. The plurality of indicium is disposed on the frame. Each of the plurality of is adapted to correspond to a length of jump rope. The jump rope cart assembly further includes a plurality of jump rope disposed on the holders. The plurality of jump rope includes jump ropes of different lengths.

Another aspect of the present disclosure relates to a jump rope cart assembly including a frame having a base portion, a support leg and a plurality of holders. The support leg is engaged with the base portion of the frame. The support leg extends in a generally vertical direction from the base portion. The plurality of holders is engaged to the support leg. Each holder is adapted to hold at least one jump rope. The jump rope cart assembly further includes a first plurality of indicium disposed on the frame. Each of the first plurality of indicium is adapted to correspond to a length of jump rope.

Another aspect of the present disclosure relates to a method for selecting a length of jump rope from a jump rope cart assembly. The method includes providing a jump rope cart assembly having a plurality of jump rope. The cart assembly includes a plurality of indicium corresponding to a plurality of lengths of jump rope. A height of a reference location on a user is compared to the plurality of indicium disposed on the cart assembly. A jump rope from the plurality of jump rope is selected which corresponds to the indicium disposed on the jump rope cart assembly that is closest to the height of the reference location.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

DRAWINGS

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

Figure 1:
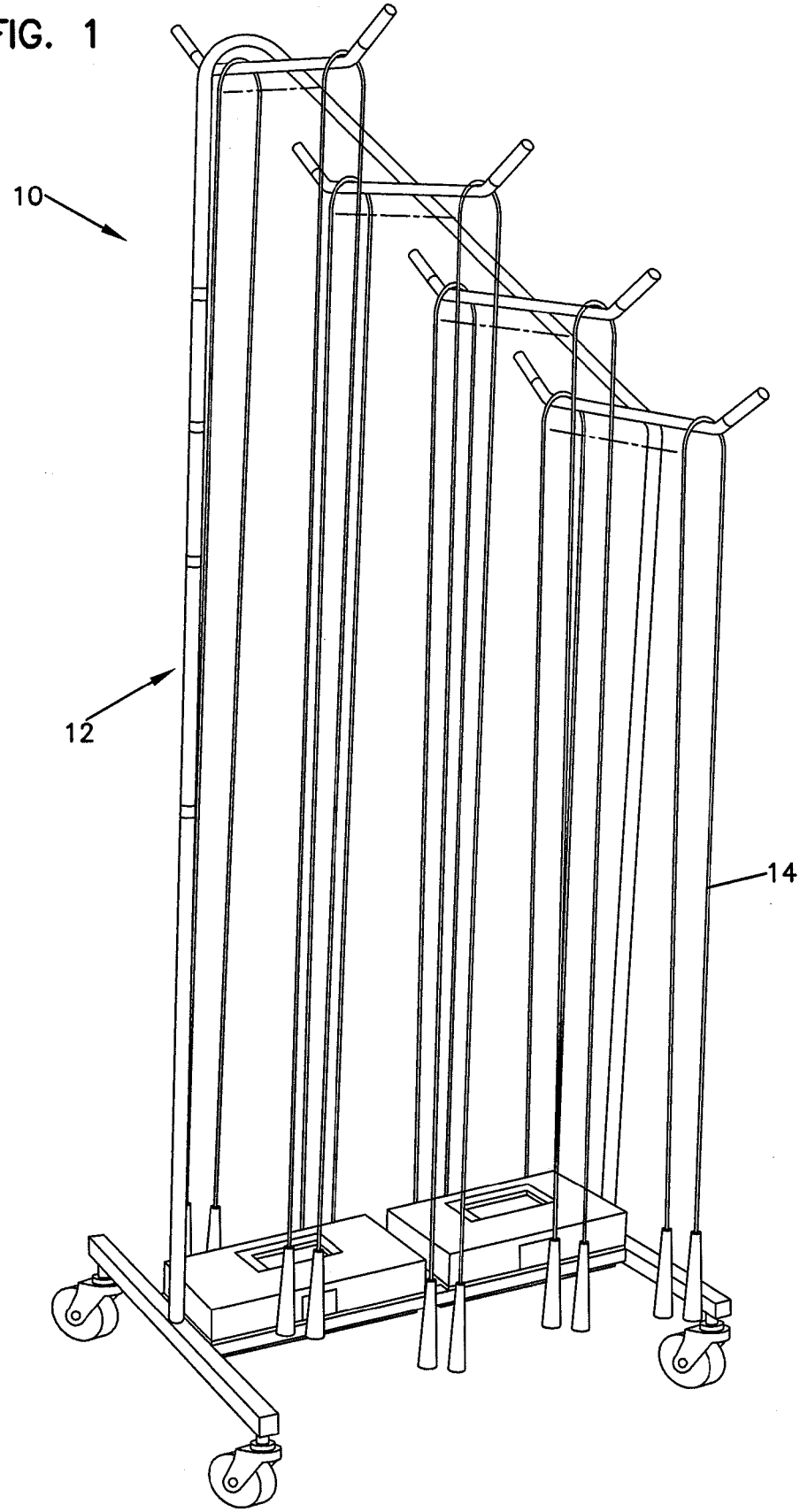
FIG. 1 is a perspective view of a jump rope cart assembly having exemplary features of aspects in accordance with the principles of the present disclosure.

Referring now to FIG. 1, a jump rope cart assembly, generally designated 10, for orderly suspension of jump ropes of varying lengths is shown. The jump rope cart assembly 10 includes a frame, generally designated 12, from which a plurality of jump ropes 14 is suspended.

Figure 2:
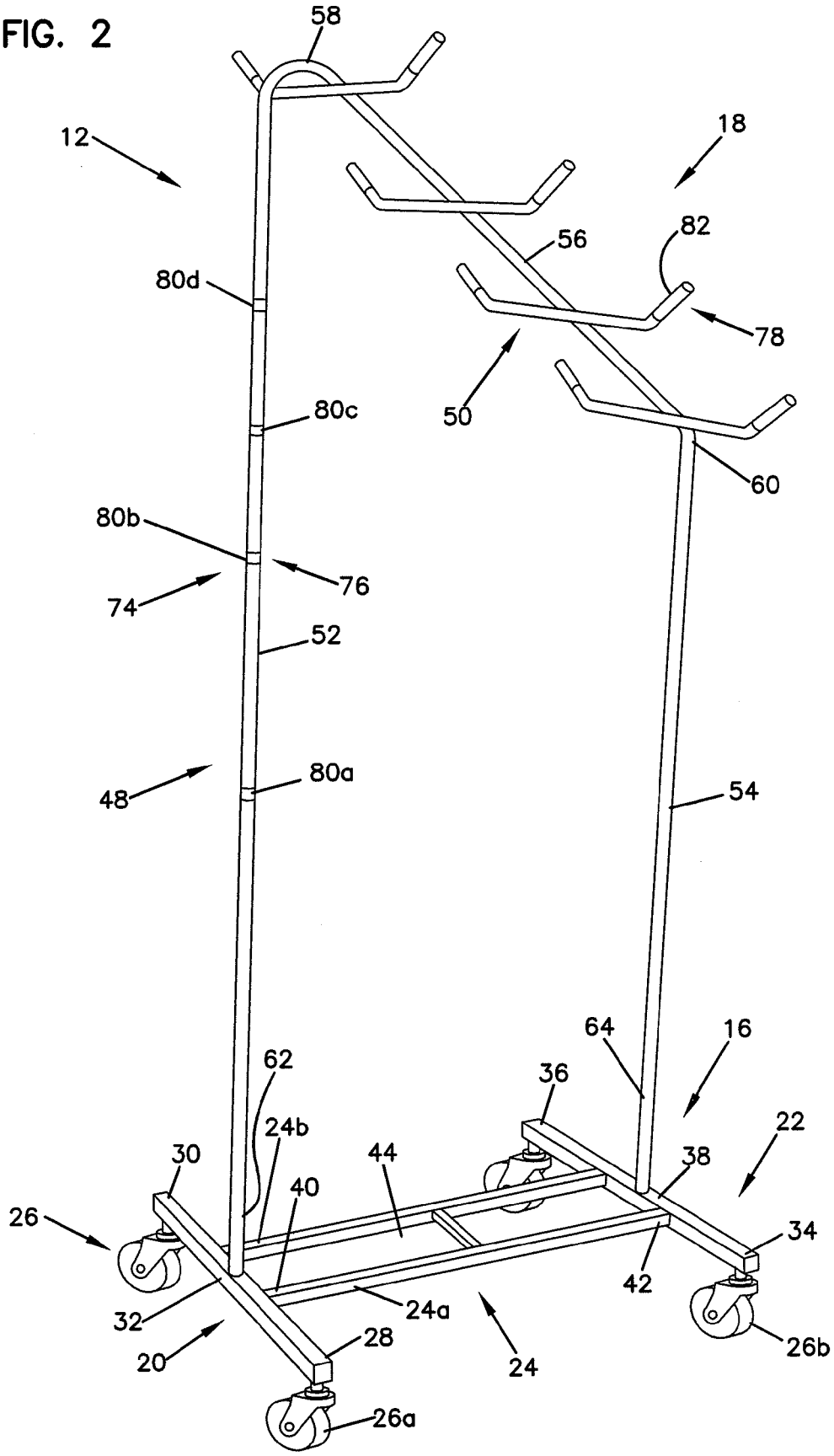
FIG. 2 is a perspective view of a frame of the jump rope cart assembly of FIG. 1.

Referring now to FIG. 2, the frame 12 of the jump rope cart assembly 10 includes a base portion, generally designated 16, and a hanger portion, generally designated 18, which is adapted for receiving the plurality of jump ropes 14.

The base portion 16 supports the hanger portion 18. In the depicted embodiment of FIG. 2, the base portion 16 includes a first base member, generally designated 20, a second base member, generally designated 22, a transverse member, generally designated 24, and a plurality of wheels 26. In the subject embodiment, and by way of example only, the first and second base members 20, 22 and the transverse member 24 are manufactured from hollow tubing having a generally square-shaped cross-section.

The first base member 20 includes a first axial end 28, an oppositely disposed second axial end 30 and a central portion 32 disposed between the first and second axial ends 28, 30. In the subject embodiment, a first plurality of wheels **26*a* are engaged to the first base member 20 with one of the first plurality of wheels 26*a* being mounted to the first axial end 28 of the first base member 20 and another of the first plurality of wheels 26*a* being mounted to the second axial end 30**.

The second base member 22 includes a first axial end 34, an oppositely disposed second axial end 36 and a central portion 38 disposed between the first and second axial ends 34, 36. In the subject embodiment, a second plurality of wheels **26*b* are engaged to the second base member 22 with one of the second plurality of wheels 26*b* being mounted to the first axial end 34 of the second base member 22 and another of the second plurality of wheels 26*b* being mounted to the second axial end 36**.

The first and second base members 20, 22 are disposed in a generally parallel orientation. The transverse member 24 of the base portion 16 connects the first and second base members 20, 22.

In the subject embodiment, there are two transverse members 24, a first transverse member **24*a* and a second transverse member 24*b*. The first and second transverse members 24*a*, 24*b* are generally parallel and extend between the first and second base members 20, 22. Each of the first and second transverse members 24*a*, 24*b* includes a first axial end 40 and an oppositely disposed second axial end 42. The first axial end 40 of the first and second transverse members 24*a*, 24*b* is engaged to the central portion 32 of the first base member 20 while the second axial end 42 is engaged to the central portion 38 of the second base member 22. In one embodiment, the first axial end 40 of the transverse member 24 is fastened to the central portion 32 of the first base member 20 while the second axial end 42 of the transverse member 24 is fastened to the central portion 38 of the second base member 22. In another embodiment, the first axial end 40 of the transverse member 24 is welded to the central portion 32 of the first base member 20 while the second axial end 42 of the transverse member 24 is welded to the central portion 38 of the second base member 22**.

Figure 3:
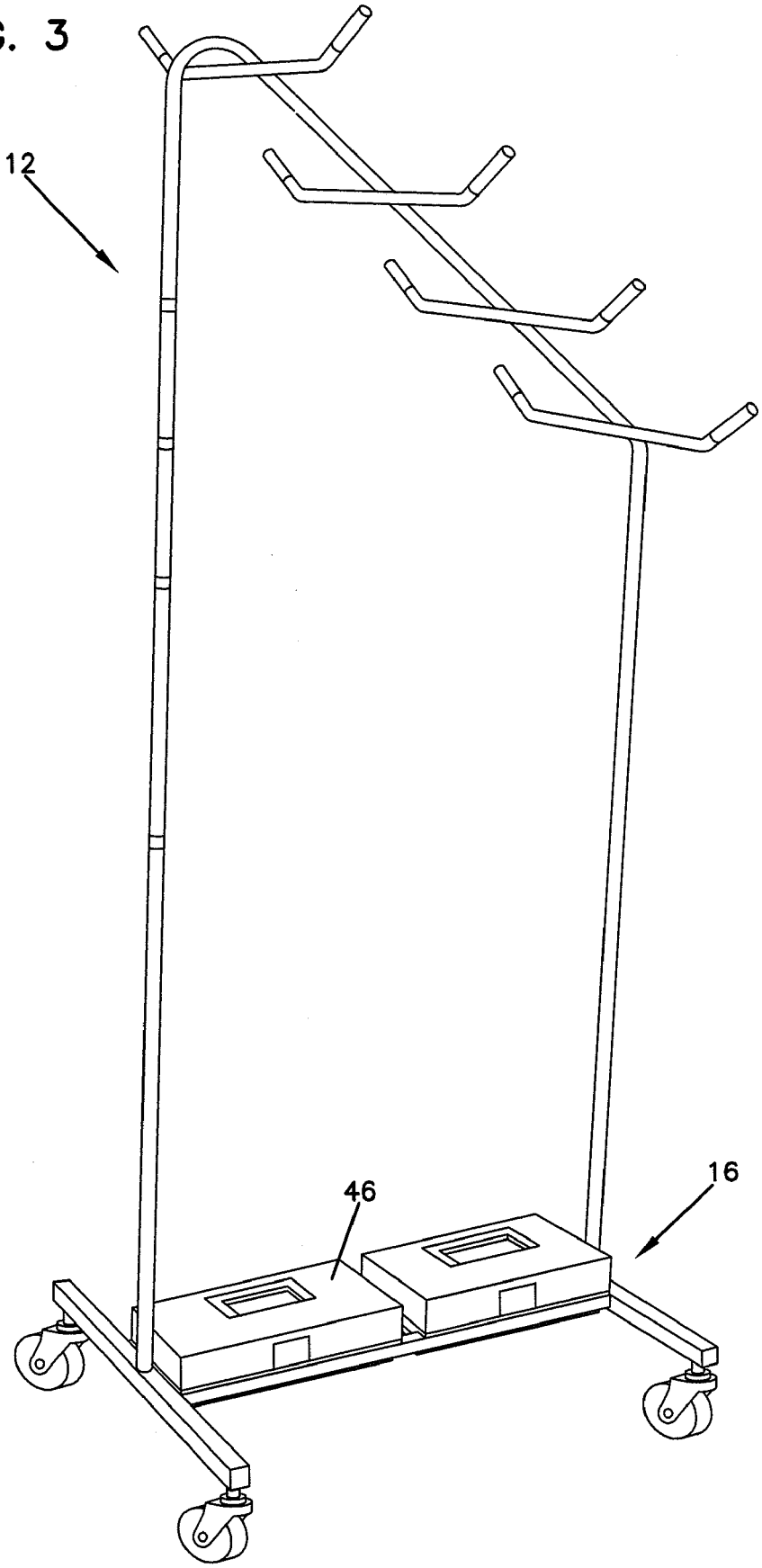
FIG. 3 is a perspective view of the jump rope cart assembly of FIG. 1.
Figure 4:
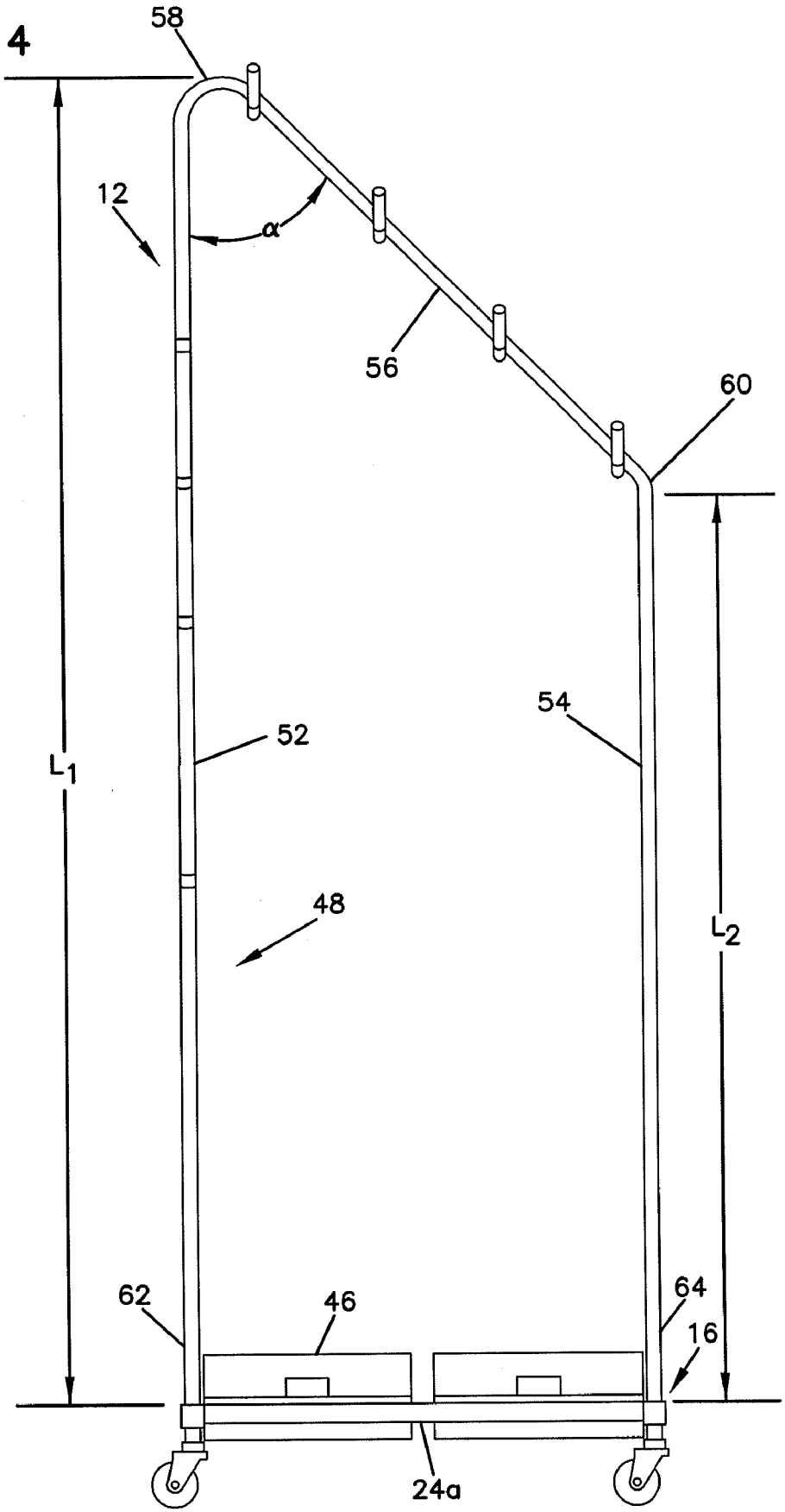
FIG. 4 is a front view of the jump rope cart assembly of FIG. 3.

Referring now to FIGS. 3 and 4, in one embodiment, the first and second transverse members 24*a*, 24*b* of the base portion 16 of the frame 12 define an opening 44 that is adapted to receive a compartment 46. The compartment 46 defines an interior that is adapted to receive items such as tools, jump rope handles, etc. In the depicted embodiment of FIG. 3, the first and second transverse members 24*a*, 24*b* of the base portion 16 define a plurality of openings 44 that is adapted to receive a plurality of compartments 46. In another embodiment, a bracket engages the compartment 46 to one or both of the transverse members 24 of the base portion 16.

Referring again to FIG. 2, the hanger portion 18 of the frame 12 includes at least one support leg, generally designated 48, that supports a plurality of holders, generally designated 50, above the base portion 16 of the frame 12. In the subject embodiment, the support leg 48 is manufactured from hollow tubing having a generally circular cross-section. In the depicted embodiment of FIG. 2, the support leg 48 of hanger portion 18 includes a first leg portion 52, an oppositely disposed second leg portion 54 and a support portion 56 disposed between the first and second leg portions 52, 54. In one embodiment, the first and second leg portions 52, 54 and the support portion 56 are integral. In another embodiment, the first and second leg portions 52, 54 and the support portion 56 are separable segments.

Referring now to FIGS. 2 and 4, the support leg 48 includes a first bend 58 disposed between the first leg portion 52 and the support portion 56 and a second bend 60 disposed between the second leg portion 54 and the support portion 56. The first and second bends 58, 60 are configured such that the first and second leg portions 52, 54 extend outwardly from the support portion 56 in a first direction. In the subject embodiment, the first and second leg portions 52, 54 are generally parallel.

In the subject embodiment, the first and second leg portions 52, 54 of the support leg 48 are engaged to the base portion 16 such that the first and second leg portions 52, 54 extend outwardly from the base portion 16 in a generally vertical direction. A first end portion 62 of the support leg 48 is engaged to the central portion 32 of the first base member 20 such that the first end portion 62 is generally perpendicular to the first base member 20. A second end portion 64 of the support leg 48 is engaged to the central portion 38 of the second base member 22 such that the second end portion 64 is generally perpendicular to the second base member 22. In one embodiment, the first end portion 62 of the support leg 48 is welded to the central portion 32 of the first base member 20 while the second end portion 64 of the support leg 48 is welded to the central portion 38 of the second base member 22.

Referring now to FIG. 4, the first leg portion 52 defines a length $L_1$ that is greater than or equal to a length $L_2$ of the second leg portion 54. In the depicted embodiment, the support portion 56 is disposed at an angle $\alpha$ with respect to the first leg portion 52 such that the support portion 56 is angled downwardly from the first leg portion 52. In the subject embodiment, the angle $\alpha$ is an oblique angle. In another embodiment, the angle $\alpha$ is about 45 degrees. In another embodiment, the angle $\alpha$ is in a range of about 15 degrees to about 75 degrees.

Figure 5:
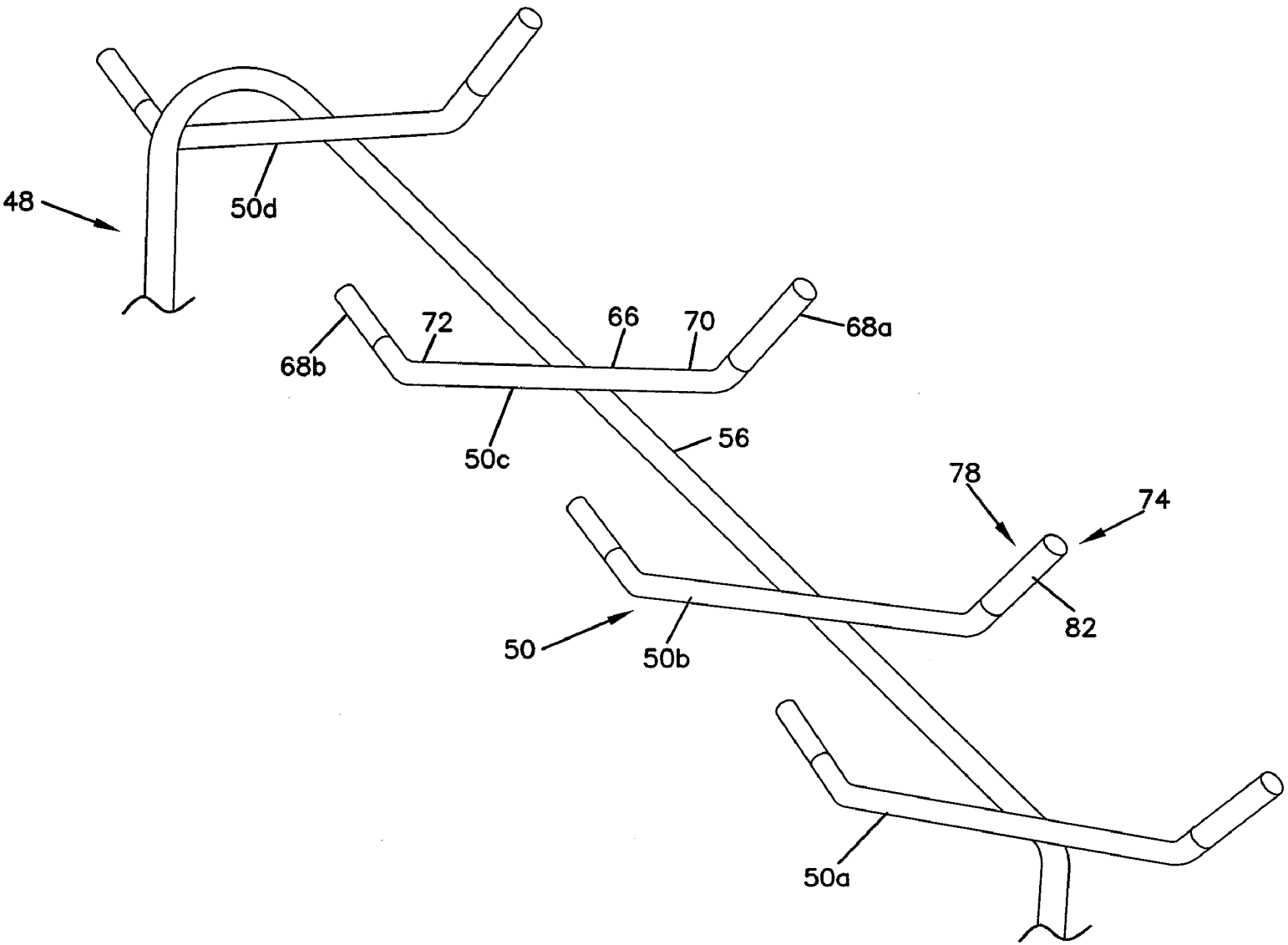
FIG. 5 is a enlarged, fragmentary view of a hanger portion of the jump rope cart assembly of FIG. 3.

Referring now to FIGS. 2 and 5, the support portion 56 includes the plurality of holders 50. Each of the plurality of holders 50 is adapted to hold at least one jump rope 14. In the subject embodiment, the plurality of holders 50 is mechanically engaged to the support portion 56. In one embodiment, the plurality of holders 50 is welded to the support portion 56.

In the depicted embodiment of FIGS. 2 and 5, the frame 12 includes four holders 50, a first holder 50*a*, a second holder 50*b*, a third holder 50*c* and a forth holder 50*d*. Each of the holders 50 includes an arm portion 66 that is adapted to hold at least one jump rope 14. In the subject embodiment, the support portion 56 of the support leg 48 is engaged to the arm portion 66 of the holder 50 at a location that is disposed generally at a midpoint of the arm portion 66.

The arm portion 66 includes a first retention portion 68*a* disposed on a first end 70 of the arm portion 66 and an oppositely disposed second retention portion 68*b* disposed on a second end 72 of the arm portion 66. In the subject embodiment, the first and second retention portions 68*a*, 68*b* are similar and will be referred to hereafter singularly and collectively as retention portion 68.

Figure 6:
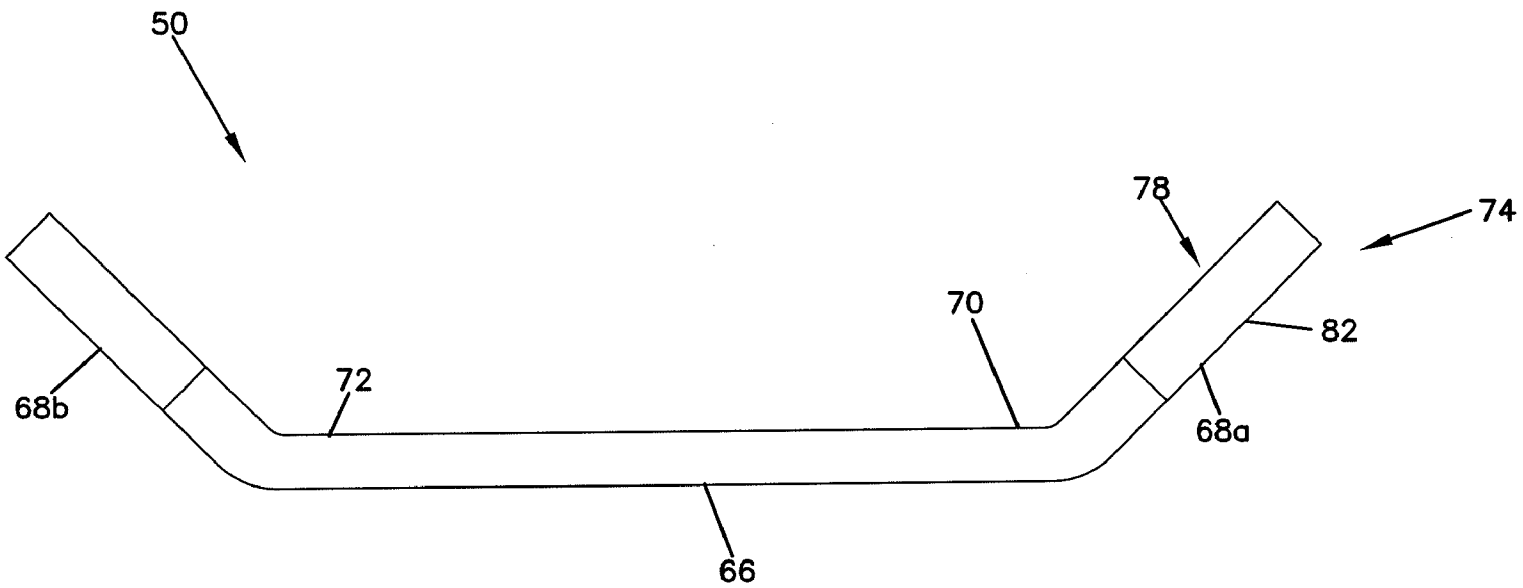
FIG. 6 is a side view of a holder suitable for use with the jump rope cart assembly of FIG. 3.

Referring now to FIGS. 5 and 6, the retention portion 68 of the holder 50 is adapted to reduce the risk of the jump rope 14 being inadvertently removed from the arm portion 66. In the subject embodiment, the retention portion 68 of the holder 50 is disposed at an angle $\beta$ (shown in FIG. 6) relative to the arm portion 66 of the holder 50. In the subject embodiment, the angle $\beta$ is an oblique angle. In another embodiment, the angle $\beta$ is in the range of about 120 degrees to about 179 degrees. In another embodiment, the angle $\beta$ is greater than or equal to about 135 degrees.

Referring now to FIGS. 1-5, each of the holders 50 is adapted to hold a jump rope 14 having a different length then a jump rope 14 disposed on an adjacent holder 50. For example, in the depicted embodiment of FIG. 1, the first holder 50*a* holds the jump rope 14 having the shortest length. The second holder 50*b* holds the jump rope 14 having a length longer than the jump rope 14 on the first holder 50*a* but shorter than the jump rope 14 on the third holder 50*c*. The forth holder 50*d* holds a jump rope 14 having the longest length.

Figure 7:
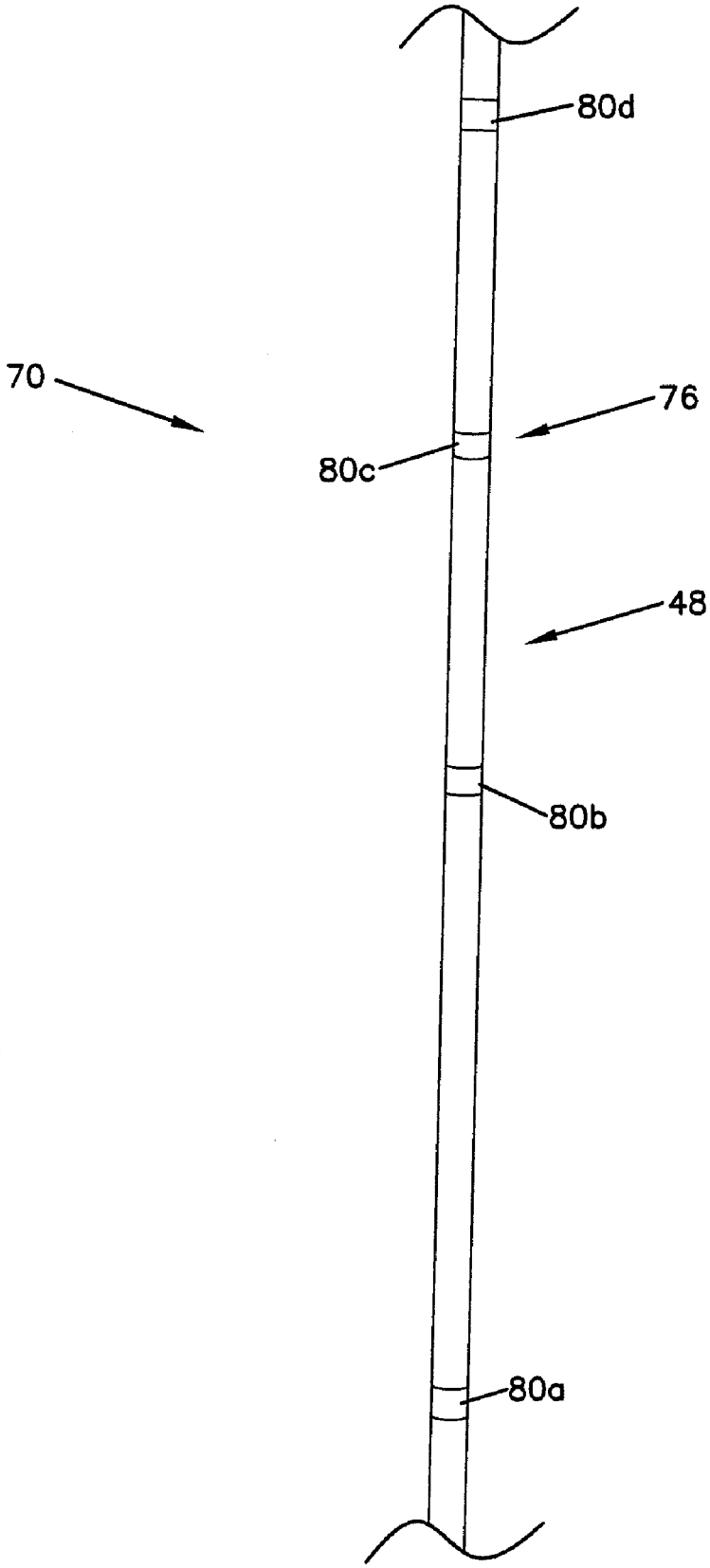
FIG. 7 is an enlarged fragmentary view of a support leg of the jump rope cart assembly of FIG. 3.

Referring now to FIGS. 2 and 7, the jump rope cart assembly 10 includes indicia, generally designated 74, corresponding to the different lengths of jump rope 14. The indicia 74 is adapted to identify a length of jump rope 14 based on a user, which will be described in greater detail subsequently. In the subject embodiment, the indicia 74 include a first set of indicia, generally designated 76, and a second set of indicia, generally designated 78.

Referring now to FIG. 7, the first set of indicia 76 is disposed on a leg of the jump rope cart assembly 10. In the subject embodiment, the leg on which the first set of indicia 76 is disposed is the support leg 48 of the jump rope cart assembly 10.

The first set of indicia 76 includes a first plurality of indicium 80. In the subject embodiment, the support leg 48 includes four indicium 80*a*, 80*b*, 80*c*, 80*d*. The first plurality of indicium 80 of the first set of indicia 76 is disposed at various heights on the support leg 48. For example, the first indicium 80*a* is disposed at the lowest height on the support leg 48 while the fourth indicium 80*d* is disposed at the highest height on support leg 48. The second and third indicium 80*b*, 80*c* are disposed between the first and fourth indicium 80*a*, 80*d* with the second indicium being disposed between the first and third indicium 80*a*, 80*c*. The various heights of the plurality of indicium 80*a-d* are adapted to correspond to various lengths of jump rope 14.

Each of the first plurality of indicium 80*a-d* is unique relative to the other indicium 80*a-d* of the first set of indicia 76. In the subject embodiment, the first set of indicia 76 includes colors. In another embodiment, the first set of indicia 76 includes any one of colors, numbers, letters, symbols, and combinations thereof.

In the subject embodiment, each of the first plurality of indicium 80*a-d* extends around the support leg 48. For example, in the depicted embodiments of FIGS. 1-4 and 7, each indicium 80*a-d* is a band of color that extends around the support leg 48. In one embodiment, the band of color is disposed on a strip (e.g., an adhesive strip, tape, etc.) that is fixed to the support leg 48. In another embodiment, the band of color is painted on the support leg 48.

In one embodiment, the second set of indicia 78 is disposed on the jump rope 14. For example, the jump rope 14 can be color coded to match the first set of indicia 76.

Referring now to FIGS. 5 and 6, the second set of indicia 78 can also be disposed on or alternatively disposed on the holders 50 of the jump rope cart assembly 10. The second set of indicia 78 includes a second plurality of indicium 82. In the subject embodiment, the second plurality of indicium 82 is disposed on at least a portion of the holder 50. In the depicted embodiment, the indicium 82 is disposed on a portion of the retention portion 68 of the holder 50. In one embodiment, each indicium 82 is a band of color that extends around a portion of the retention portion 68 of the holder 50. In one embodiment, the band of color is disposed on a strip (e.g., an adhesive strip, tape, etc.) that is fixed to the retention portion 68 of the holder 50. In another embodiment, the band of color is painted on the holder 50.

The indicium 82 of the second set of indicia 78 corresponds to the indicium 80 of the first set of indicia 76. For example, if one of the indicium 80 of the first set of indicia 76 has a red marking, at least one of the indicium 82 of the second set of indicia 78 will have the same red marking.

Figure 8:
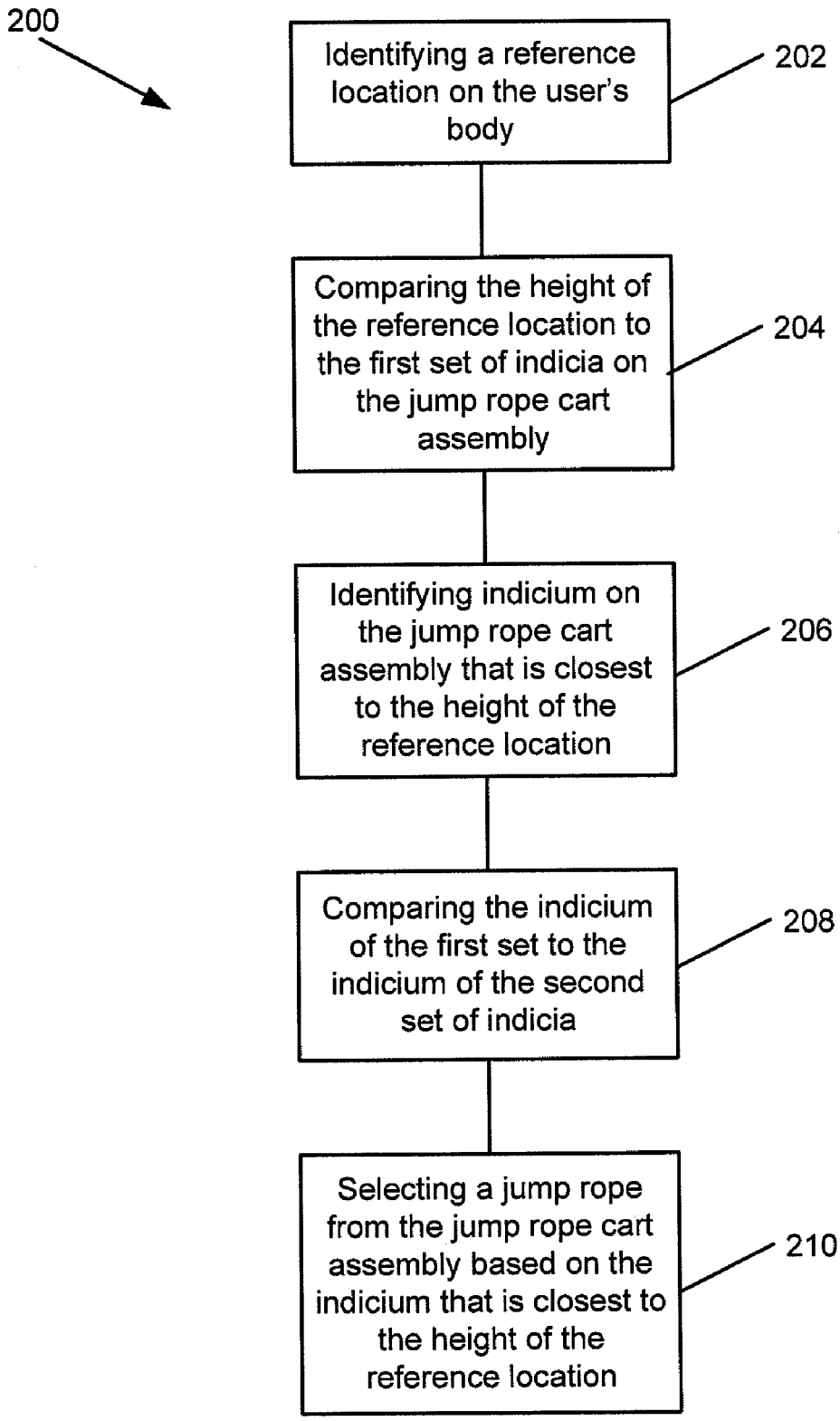
FIG. 8 is a representation of a method for selecting a length of jump from a cart assembly.

Referring now to FIGS. 1 and 8, a method 200 of using the jump rope cart assembly 10 will be described. Standing adjacent to the jump rope cart assembly 10, a user is able to identify a length of jump rope 14 that is suitable for his/her use.

In step 202, the user identifies a reference location on his/her body. In the subject embodiment, the reference location is mid-sternum on the user. In one embodiment, the mid-sternum reference location is at or near the user's nipple line. In another embodiment, the reference location is the user's height. In another embodiment, the reference location is the height of the user's shoulders.

In step 204, the user compares the height of the reference location on the user's body to the first set of indicia 76 on the cart assembly. In one embodiment, the height comparison is made using an outstretched hand (e.g., palm facing up or down) that is parallel to the ground on which the jump rope cart assembly 10 is stationed. Keeping the user's outstretched hand at the height of the reference location, the user extends his/her arm such that the outstretched hand is adjacent to the first set of indicia 76.

In step 206, the user identifies the indicium 80 of the first set of indicia 76 that is closest to the height of the reference location. In step 208, the user compares the indicium 80 of the first set of indicia 76 to the indicium 82 of the second set of indicia 78. In one embodiment, the second set of indicia 78 is dispose on the holders 50. In another embodiment, the second set of indicia 78 is disposed on the jump ropes 14. In step 210, the user selects a jump rope 14 associated with indicium 82 that is the same as the indicium 80 of the first set of indicia 76 that was closest to the height of the reference location.

In one embodiment of the jump rope cart assembly 10, the method 200 of using the jump rope cart assembly 10 may be described on instructions that are packaged with the jump rope cart assembly 10. In another embodiment of the jump rope cart assembly 10, the method 200 of using the jump rope cart assembly 10 may be included on the packaging of the jump rope cart assembly 10.

Various modifications and alterations of this disclosure will become apparent to those skilled in the art without departing from the scope and spirit of this disclosure, and it should be understood that the scope of this disclosure is not to be unduly limited to the illustrative embodiments set forth herein.

What is claimed is:

1. A jump rope cart assembly comprising:

a frame having:

a base portion including a plurality of wheels;

a hanger portion engaged to the base portion, the hanger portion including:

a support leg extending outwardly from the base portion, the support leg including a first leg portion that is generally vertical;

a plurality of holders;

a plurality of jump rope disposed on the holders, wherein the plurality of jump rope includes jump ropes of different lengths; and a first plurality of indicium disposed on the first leg portion of the support leg, each of the indicium being disposed on the first leg portion at a height that is unique relative to the other indicium of the first plurality of indicium, the first plurality of indicium being arranged on the first leg portion so as to identify a length of jump rope based on a reference location on a vertically oriented user, wherein the first plurality of indicium is selected from the group consisting of colors, numbers, letters, symbols and combinations thereof;

further comprising a second plurality of indicium disposed on the jump rope, the second plurality of indicium corresponding to the first plurality of indicium;

further comprising a third plurality of indicium disposed on the plurality of holders, the third plurality of indicium corresponding to the first plurality of indicium.

2. A jump rope cart assembly as claimed in claim 1, wherein the base portion includes a first base member and a second base member that are generally parallel.

3. A jump rope cart assembly as claimed in claim 1, wherein the support leg includes a support portion that includes the plurality of holders, wherein the support portion is disposed at an oblique angle relative to the first leg portion.

4. A jump rope cart assembly as claimed in claim 1, wherein the base portion defines an opening.

5. A jump rope cart assembly as claimed in claim 1, further comprising a compartment engaged to the base portion.

6. A jump rope cart assembly as claimed in claim 1, wherein the reference location of the user is the user's height.

7. A jump rope cart assembly as claimed in claim 1, wherein the reference location of the user is mid-sternum on the user.

8. A jump rope cart assembly as claimed in claim 1, wherein the first, second, and third plurality of indicium includes matching colors.

9. A jump rope cart assembly comprising:

a frame having:

a base portion;

a support leg engaged with the base portion, the support leg including a first leg portion, an oppositely disposed second leg portion and a support portion that extends between the first and second leg portions, the first and second leg portions being generally vertical;

a plurality of holders engaged to the support portion of the support leg, wherein each of the holders is adapted to hold at least one jump rope; and a compartment disposed on the base portion of the frame, the compartment defining an interior region;

a first plurality of indicium disposed on the first leg portion of the support leg, each of the first plurality of indicium being disposed on the first leg portion at a height that is unique relative to the other indicium of the first plurality of indicium so as to identify a length of jump rope based on a reference location on a vertically oriented user;

a second plurality of indicium disposed on the plurality of holders, the second plurality of indicium corresponding to the first plurality of indicium; and a plurality of jump rope disposed on the holders, wherein the plurality of jump rope includes jump ropes of different lengths;

wherein the first and second plurality of indicium are matching colors;

wherein each of the plurality of jump ropes includes a color that matches the matching colors of the first and second plurality of indicium.

* * * * *